United States Patent [19]

Hassan

[11] Patent Number: 4,875,791

[45] Date of Patent: Oct. 24, 1989

[54] LIQUID DISPENSING BRUSH

[76] Inventor: Shawky A. Hassan, 1146 S. Linden Rd., Flint, Mich. 48504

[21] Appl. No.: 576,919

[22] Filed: Feb. 3, 1984

[51] Int. Cl.[4] ..... A46B 11/04; A46B 17/04

[52] U.S. Cl. ..... 401/176

[58] Field of Search ..... 132/84 R, 84 B, 84 D; 401/286, 287, 288, 289, 290

[56] References Cited

U.S. PATENT DOCUMENTS

| | | | |
|---|---|---|---|
| 1,014,784 | 1/1912 | Tate . | |
| 1,121,788 | 12/1914 | Bongiovanni . | |
| 2,323,378 | 7/1943 | Champion et al. | 221/102 |
| 2,616,649 | 10/1952 | Banks | 15/136 |
| 2,634,025 | 4/1953 | Hausner | 132/84 R |
| 2,766,472 | 10/1956 | Durrett | 15/138 |
| 4,176,980 | 12/1979 | O'Neal et al. | 401/287 |
| 4,229,116 | 10/1980 | Moore | 401/275 |
| 4,375,924 | 3/1983 | Lemire | 401/287 |
| 4,408,920 | 10/1983 | Walther et al. | 132/84 D |
| 4,421,433 | 12/1983 | Villanueva | 401/286 |

*Primary Examiner*—Robert Peshock

*Attorney, Agent, or Firm*—Gifford, Groh, Sheridan, Sprinkle and Dolgorukov

[57] ABSTRACT

A liquid dispensing brush primarily used in dispensing liquid cleanser. The brush includes a reservoir which holds a predetermined amount of liquid cleanser and an arm with a longitudinal passage to deliver the cleanser from the reservoir to the head of the brush. The head of the brush comprises several sets of bristles and outlet means to allow the liquid cleanser to flow from the lingitudinal passage to the bristles. In order to effectuate the flow of liquid cleanser from the reservoir to the bristles, means are provided whereby the brush is tilted to raise the reservoir higher than the head of the brush. A cap, with a flexible clip for easy storage, provides the tilting necessary to effectuate fluid flow. In use, the brush is placed on a flat surface in the tilted position for a predetermined length of time to allow a sufficient amount of liquid cleanser to flow to the bristles.

16 Claims, 1 Drawing Sheet

LIQUID DISPENSING BRUSH

BACKGROUND OF THE INVENTION

I. Field of the Invention

This invention relates to brushes and, in particular, to a disposable brush with means for dispensing liquid cleanser.

II. Description of the Prior Art

Numerous liquid dispensing brushes exist for a wide range of purposes with only the means for dispensing the liquid cleaner differing. Many of these devices utilize intricate and uneconomical methods of dispensing the liquid ranging from mechanical pumps to squeeze mechanisms. Most of these devices are refillable which also adds to the cost of producing these devices.

U.S. Pat. No. 1,014,784 discloses a liquid dispensing toothbrush with a refillable liquid reservoir. The liquid tooth cleaner flows to the bristles of the brush by way of a pair of aligned ports between the reservoir and the head of the toothbrush. The flow is controlled by rotating the reservoir relative to the head thereby closing the ports. Thus, the device comprises several intricate parts which cooperate to control and dispense the liquid tooth cleanser to the brush bristles.

U.S. Pat. No. 2,323,378 discloses a similar liquid dispensing toothbrush which utilizes a mechanical pump to force the liquid tooth cleanser to the bristles. This device is also refillable and designed to be used a number of times before disposed of when the bristles have worn out.

Other devices utilize a squeeze mechanism to force the liquid cleanser or toothpaste to the bristles. As with the above-noted devices, these devices require the cooperation of several intricate parts to accomplish the desired result.

SUMMARY OF THE PRESENT INVENTION

The present invention is an improved liquid dispensing brush which overcomes all of the disadvantages of the previously known liquid dispensing brushes.

The brush according to the present invention comprises generally an elongated arm attached to a fluid reservoir. A passage runs the length of the arm from the fluid reservoir to several openings at the base of the bristles which are secured to the end of the arm. The entire structure is essentially of one piece construction with a predetermined amount of liquid cleanser contained within the fluid reservoir. The device also comprises a cap which may be detachably secured to the fluid reservoir and is designed to protect the brush head and bristles. A flexible clip is attached to the cap for convenient pocket storage of the device and to provide proper fluid flow.

Flow of the liquid cleanser is effectuated by tilting the toothbrush at an angle such that the reservoir is higher than the brush head allowing the fluid to pass through the passage to the brush head. Means are provided whereby the device can be placed on a flat surface with the reservoir held in a raised position. The preferred embodiment comprises a cap with a flexible clip which provides the proper tilt to effectuate fluid flow. When the brush is not in use and the device is placed on a flat surface, the flexible clip attached to the cap causes the bristle portion of the brush to be held above the fluid reservoir thereby preventing the fluid from flowing through the passage to the brush head. When the cap is reversed and placed on the end of the brush opposite the brush head, the reservoir is held higher than the bristles permitting fluid flow.

The fluid reservoir may be filled with a variety of liquids for use, for example, as a cleaning brush, a toothbrush or a cosmetic brush.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of the preferred embodiment of the present invention when read in conjunction with the accompanying drawing, in which like reference characters refer to like parts throughout the views, and in which.

DETAILED DESCRIPTION OF THE PREFERRED EMBODIMENT

Figure 1:
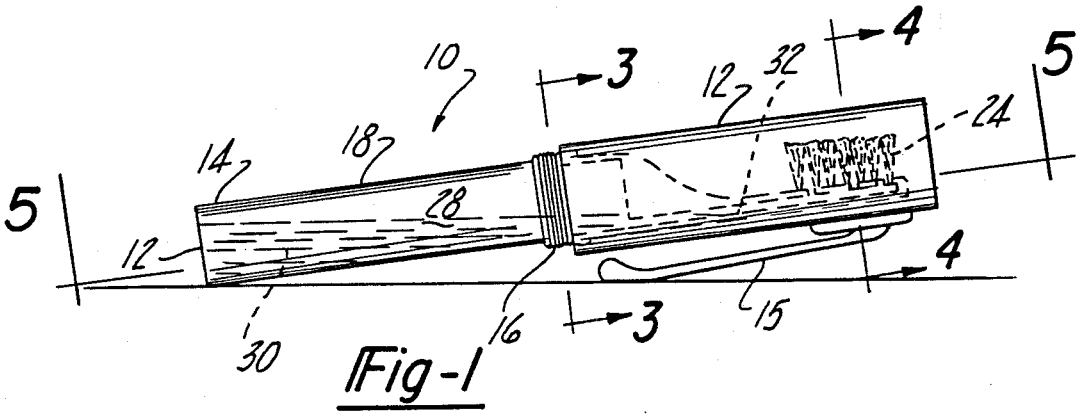
FIG. 1 is a side plan view of the device in its storage position.

Referring generally to FIGS. 1-5, there is shown a liquid dispensing brush 10 embodying the present invention and comprising a main body 14 and a capping member 12 which can be rotatably secured to the main body 14 by way of threads 16. The capping member 12 is designed to protect the bristles 24 from dirt and debris during storage of the device and is provided with a flexible clip 15 for easy pocket storage. The body 14 is preferably of one piece construction and made of an inexpensive plastic. Similarly, the capping member 12 is also made of plastic.

In the preferred embodiment the body 14 comprises tubular handle 18, and elongated arm 20. Secured to first end 22 of the arm 20 is a set of bristles 24 which are of the conventional type found in standard brushes.

Figure 5:
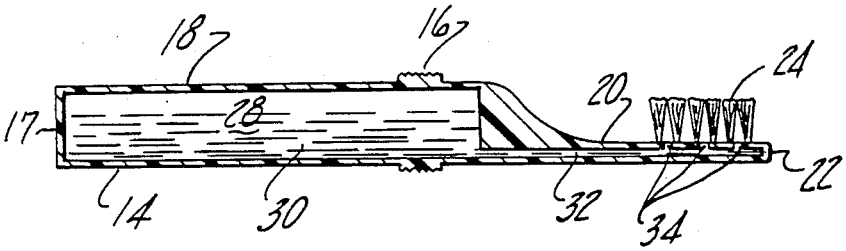
FIG. 5 is a cross-sectional view taken along lines 5—5 of FIG. 1.

Referring specifically now to FIG. 5, the handle 18 comprises a fluid reservoir 28 which contains the liquid cleanser 30. The reservoir 28 preferably is of a predetermined volume and contains sufficient cleanser 30 to last through a predetermined number of uses. Once the liquid cleanser 30 is exhausted the device is discarded since no means are provided for refilling the reservoir 28. However, because of the low cost construction of the device and the convenience provided by the present invention, replacement becomes quite practical.

Referring still to FIG. 5, the elongated brush arm 20, comprises a longitudinal passage 32 which runs from the fluid reservoir 28 to a series of outlets 34 located in the first end 22 of the arm 20. The outlets 34 permit the liquid cleanser to reach the base of the bristles 24.

In use, the liquid cleanser 30 flows through the longitudinal passage 32 and to the bristles by way of the outlets 34 whenever the device 10 is held at the proper angle. To effectuate this flow, the device may be placed on a flat surface with the cap 12 attached to end 17. In this position, the flexible clip 15 causes the reservoir 28 to be held at a level higher than the end 22 of the arm 20

Figure 2:
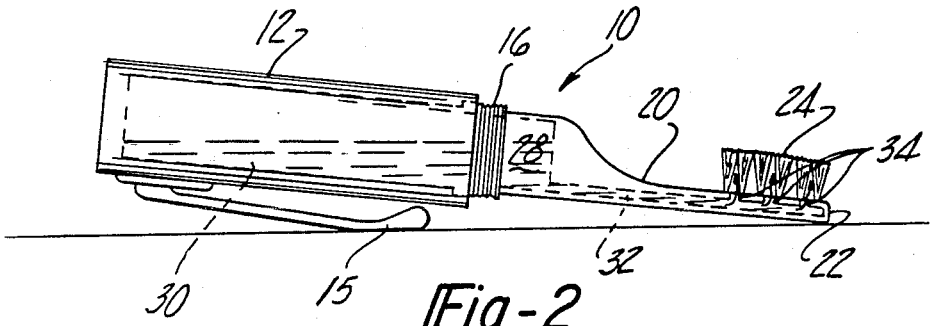
FIG. 2 is a side plan view of the device in its flow position.
Figure 3:
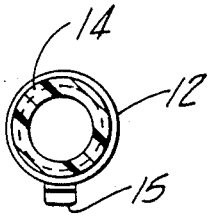
FIG. 3 is a cross-sectional view taken along lines 3—3 of FIG. 1.
Figure 4:
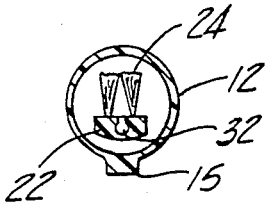
FIG. 4 is a cross-sectional view taken along lines 4—4 of FIG. 1.

(FIG. 2). The length of time the device is retained in this position determines the amount of cleanser 30 that will reach the bristles.

After completing the brushing function, the cap 12 is secured to the main body 14 such that the bristles 24 are protected. Furthermore, the device 10 may be stored in either an upright position such that gravity will not allow the liquid to flow the bristles (i.e. in a shirt pocket) or the device 10 may be stored on a flat surface in which case the clip 15 of the cap 12 will cause end 22 of the arm 20 to be raised higher than the reservoir 28 (FIG. 1).

The foregoing detailed description has been given for clearness of understanding only and no unnecessary limitations should be understood therefrom as some modification will be obvious to those skilled in the art.

What is claimed is:

1. A liquid dispensing brush comprising:

an elongated arm having a longitudinal passage formed therein, said arm having first and second ends;

a plurality of bristles secured adjacent to said first end of said arm;

a fluid outlet formed in said arm adjacent said bristles, in fluid communication with said passage;

a fluid reservoir attached to said second end of said arm, in fluid communication with said passage, said reservoir having a predetermined volume; and means for positioning said brush such that said outlet is below said reservoir;

wherein said brush further comprises a fluid disposed in said reservoir, wherein said fluid flows only by gravity from said reservoir to said outlet.

2. The invention according to claim 10, wherein said reservoir is defined by rigidly connected walls.

3. The invention according to claim 1, wherein said arm and said reservoir are integrally constructed from plastic.

4. The invention according to claim 1, wherein said fluid comprises a liquid cleanser.

5. The invention according to claim 1, wherein said reservoir comprises an end opposite said arm, and said brush further comprises a cylindrical cap detachably securable over said reservoir end.

6. The invention according to claim 5, wherein said positioning means comprises a flexible clip secured to said cap.

7. The invention according to claim 5, wherein said cap is additionally detachably securable over said arm and said bristles.

8. The invention according to claim 7, wherein said reservoir comprises an outer threaded periphery, and said cap is matchingly threaded, such that said cap engages said periphery when secured over either said reservoir or said arm.

9. A liquid dispensing brush comprising:

an elongated arm having a longitudinal passage formed therein, said arm having first and second ends;

a plurality of bristles secured adjacent to said first end of said arm;

a fluid outlet formed in said arm adjacent said bristles, in fluid communication with said passage;

a fluid reservoir attached to said second end of said arm, in fluid communication with said passage, said reservoir having a predetermined volume; and means for positioning said brush such that said outlet is below said reservoir;

wherein said brush further comprises a fluid disposed in said reservoir, wherein the viscosity of said fluid is such that said fluid flows through said outlet only by gravity.

10. The invention according to claim 9, wherein said reservoir is defined by rigidly connected walls.

11. The invention according to claim 9, wherein said arm and said reservoir are integrally constructed from plastic.

12. The invention according to claim 9, wherein said fluid comprises a liquid cleanser.

13. The invention according to claim 9, wherein said reservoir comprises an end opposite said arm, and said brush further comprises a cylindrical cap detachably securable over said reservoir end.

14. The invention according to claim 13, wherein said positioning means comprises a flexible clip secured to said cap.

15. The invention according to claim 13, wherein said cap is additionally detachably securable over said arm and said bristles.

16. The invention according to claim 15, wherein said reservoir comprises an outer threaded periphery, and said cap is matchingly threaded, such that said cap engages said periphery when secured over either said reservoir or said arm.

* * * * *